US005323175A

United States Patent [19]

Doi et al.

[11] Patent Number: 5,323,175

[45] Date of Patent: Jun. 21, 1994

[54] SCREEN DISPLAY ELEMENT

[75] Inventors: Toshio Doi; Shigeo Mizugaki; Yoshinori Hayashi, all of Hyogo, Japan

[73] Assignee: Mitsubishi Denki Kabushiki Kaisha, Tokyo, Japan

[21] Appl. No.: 822,483

[22] Filed: Jan. 17, 1992

[30] Foreign Application Priority Data

Jan. 21, 1991 [JP] Japan ..... 3-020570

[51] Int. Cl.[5] ..... G09G 1/14

[52] U.S. Cl. ..... 345/194; 345/141

[58] Field of Search ..... 340/730, 731, 732–735; 358/105, 135; 345/194, 136, 141, 143, 144, 192, 193, 195, 189

[56] References Cited

U.S. PATENT DOCUMENTS

| | | | |
|---|---|---|---|
| 3,868,673 | 2/1975 | Mau, Jr. et al. | 340/750 |
| 4,196,431 | 4/1980 | Lee | 340/749 |
| 4,283,724 | 8/1981 | Edwards | 340/731 |
| 4,404,552 | 9/1983 | Hirahata et al. | 340/750 |
| 4,595,996 | 6/1986 | Morley et al. | 340/799 |
| 4,849,747 | 7/1989 | Ogawa et al. | 340/730 |
| 4,907,172 | 3/1990 | Nishiyama et al. | 340/735 |
| 4,942,390 | 7/1990 | Do et al. | 340/735 |

OTHER PUBLICATIONS

Mitsubishi Semiconductors M50458-XXXSP User's Manual, 1990, Mitsubishi Electric Corporation.

*Primary Examiner*—Ulysses Weldon
*Assistant Examiner*—Gin Goon

[57] ABSTRACT

In order to reduce the capacity of a character ROM without reducing the character information, n-bit bit pattern data and sequence data having information necessary for composing n-bit m components are stored in first memory means (character ROM). Second memory means has addresses corresponding to each display position on the screen and holds addresses for the first memory means as a data. In accordance with the address from the second memory means and the sequence data from the first memory means, address modifying means produces an address of a scanning line with respect to pertinent character for the first memory means. According to this address, the bit pattern data is read out from the first memory means.

12 Claims, 11 Drawing Sheets

SCREEN DISPLAY ELEMENT

BACKGROUND OF THE INVENTION

1. Field of the Invention

The present invention relates to a screen display element for displaying characters (including numerals and marks) on a display device such as CRT.

2. Description of the Prior Art

FIG. 8 is a block diagram showing a structure of a conventional screen display element. In FIG. 8, numeral 1*a* represents a CROM (character ROM) storing bit pattern data as a component of a character consisted of n×m dots, numeral 2 represents a CRAM (character RAM) having addresses corresponding to each display position on the screen for holding addresses for the CROM 1*a* as data, numeral 7 represents a line selecting section for selecting data for 1 line of necessary scanning line from data output for 1 character in the CROM 1*a*, numeral 5 represents a P/S converting section (parallel/serial converting section) for converting data outputted in parallel from the line selecting section 7 into serial signals necessary for screen display, and numeral 6 represents a display control section for controlling the CROM 1*a*, CRAM 2, line selecting section 7, and the P/S converting section 5 and outputting image signals necessary for screen display.

FIG. 9 is a schematic diagram of the main part of the CROM 1*a*. The CROM 1*a* comprises a decoder 91 for decoding address from an address line 90, memory cells 93 arranged in matrix storing bit pattern data, data lines 94 for transmitting data of the memory cells 93 read out by signals from word lines 92, and a sense amplifier 95 for amplifying the data in the data lines 94 to logical level.

The structure of the CROM 1*a*, in case of a character set having 256 characters in which 1 character is represented by 12 dots in width and 18 dots in length, for example, is (12×18=) 216 bits×256 words, and 216 bits for 1 character among the 256 characters with 8-bit address are read out. A specific address in the CRAM 2 corresponds to a specific position on the screen, and written specific data corresponds to a specific character, i.e. to a specific address in the CROM 1*a*. For example, when the screen is consisted of 256 characters calculated by a multiplication of 16 columns in width and 16 rows in length where 1 character is made to be 1 word which holds address (256 words=8 bits) as a 8-bit data for the CROM 1*a*, the structure of the CRAM 2 is of 8 bits×256 words. Among the 8-bit addresses, upper 4 bits are used for indicating 1 row among of 16 rows and lower 4 bits are used for indicating 1 column among 16 columns.

FIG. 10 is a flowchart showing the operational procedure in the conventional example and FIG. 11 is an auxiliary illustration for FIG. 10. At steps 101–106 in FIG. 10, the display control section 6 requests the CRAM 2 for data for a line of a scanning line. Then, the CRAM 2 indicates 1 address of the CROM 1*a*. Thus, the CROM 1*a* outputs whole bit data of 1 display character to the P/S converting section 5 through the line selecting section 7. The P/S converting section 5 converts data for 1 line of 1 character, which is sent sequentially, into consecutive data for 1 line.

The operation of the conventional screen display element will now be explained referring to FIGS. 8–11.

The data written in the CRAM 2 corresponds to characters (marks and the like) to be displayed on the screen. When a specific character is to be displayed on a specific position on the screen, data corresponding to the specific character is written in address memory corresponding to the specific position in the CRAM 2. The data written in the CRAM 2 corresponds to a specific address in the CROM 1*a*. For example, it is assumed that data "0" corresponds to a character "A" and data "1" corresponds to a character "B". A specific data is written in a specific address in the CRAM 2 by means of, for example, a CPU (not shown). For example, data "0" is written in an address "0" of the CRAM 2 and data "1" is written in an address "1". The specific address in the CRAM 2 corresponds to the specific position on the screen. Here, the addresses "0" and "1" correspond to 1st column and 2nd column in 1st row respectively on the screen and "AB" will be displayed in upper left hand side on the screen. The display control section 6 makes the CRAM 2, CROM 1*a*, line selecting section 7, and the P/S converting section 5 output necessary data at necessary timing for screen display, so as to display them on the screen.

Assuming that a real screen display is being performed by scanning line which proceeds from left to right and from upper part to lower part, the procedure for the screen display will be as follows.

When 1st line on the screen is to be indicated (steps 101, 102, 103), the display control section 6 supplies sequentially addresses corresponding to the 1st row to the CRAM 2. Data which represents a character in the 1st row which is read out sequentially from the CRAM 2 is supplied sequentially to the CROM 1*a* as an address, and bit pattern data 216 bits of the character to be displayed in the 1st row is read out from the CROM 1*a*. The display control section 6 selects a first 12 bits necessary for displaying the 1st line from among 216 bits which are sequentially read out by the line selecting section 7, and outputs it. The P/S converting section 5 converts 12-bit parallel data outputted sequentially from the line selecting section 7 into serial data sequentially so as to output it. The display control section 6 converts the serial data outputted from the P/S converting section 5 into image signal necessary for screen display and outputs it to a CRT which is not shown, so as to perform screen display.

When 2nd line on the screen is to be displayed (steps 104, 105, 106), although it is the same as the case of the 1st line, the display control section 6 selects 2nd 12-bit necessary for displaying the 2nd line from among 216 bits read out sequentially by the line selecting section 7, and outputs it.

Accordingly, when an arbitrary Nth line on the screen is to be displayed, the display control section 6 supplies sequentially an address corresponding to $\{(N-1)\div 18+1\}$th row to the CRAM 2. Data representing the character of 1st row read out sequentially from the CRAM 2 is supplied sequentially to the CROM 1*a* as address, and bit data 216 bits of the character to be displayed in $\{(N-1)\div 18+1)\}$th row is read out sequentially from the CROM 1*a*. The display control section 6 makes the line selecting section 7 select sequentially $\{(N-1)\div 18+1)\}$th 12-bit necessary for displaying Nth line from among 216 bits read out sequentially from the CROM 1*a* and make it outputted, and the P/S converting section 5 converts parallel data of 12-bit selected and outputted sequentially from the line selecting section 7 into serial data sequentially so as to output. The display control section 6 converts the serial data outputted from the P/S converting section 5 into image signal necessary for displaying on the screen so as to make the CRT (not shown) display the character.

Supposing that character information having such a bit structure shown in FIG. 12 as a combination of 14 sets of 1 row in width, 1st row and 5th–12th rows, and 3rd row and 4th row have the same number of bits, respectively. That is, such a character information has a plurality of data with the same bit structure, so that it provide a high redundancy inevitably. Accordingly, although the conventional screen display element such as described above has the high redundancy of the character information in structure, all characters should have data having the same number of bits. As a result, there is a problem that the capacity of the CROM for storing the data will be necessarily enlarged.

SUMMARY OF THE INVENTION

The object of the present invention, in view of the above-mentioned problem, is to provide a screen display element in which the capacity of memory means (CROM) for storing the bit pattern data as a character component is reduced, and moreover, the same character information as in the conventional screen display element can be obtained even if the capacity is reduced.

For this end, the screen display element relating to the present invention comprises first memory means (CROM 1) storing n-bit bit pattern data and sequence data having information necessary for composing n-bit m components, second memory means (CRAM 2) having addresses corresponding to each display position on the screen and holding addresses for the first memory means as data, modifying means (address modifying section 3) for producing an address of a scanning line with respect to pertinent character for the first memory means in accordance with the address from the second memory means and the sequence data from the first memory means, parallel/serial converting means (P/S converting section 5) for converting data outputted in parallel from the first memory means in accordance with the address into serial signal necessary for screen display, and display control means (display control section 6) for controlling the above-mentioned all means and outputting image signals necessary for screen display.

That is, the first memory means (CROM 1) stores n-bit bit pattern data and sequence data having information necessary for composing n-bit m components. The second memory means (CRAM 2) has addresses corresponding to each display position on the screen and holds addresses for the first memory means as data. The address modifying means (address modifying section 3) produces address of the scanning line with respect to pertinent character for the first memory means in accordance with the address from the second memory means and the sequence data from the first memory means. The parallel/serial converting means (P/S converting section 5) converts data outputted in parallel from the first memory means in accordance with said address into serial signals necessary for screen display. The display control means (display control section 6) controls the above-mentioned all means and outputs image signals necessary for screen display.

The above and other objects, features, and advantages of the invention will become more apparent from the following description when taken in conjunction with the accompanying drawings.

DESCRIPTION OF THE PREFERRED EMBODIMENT

Figure 1:
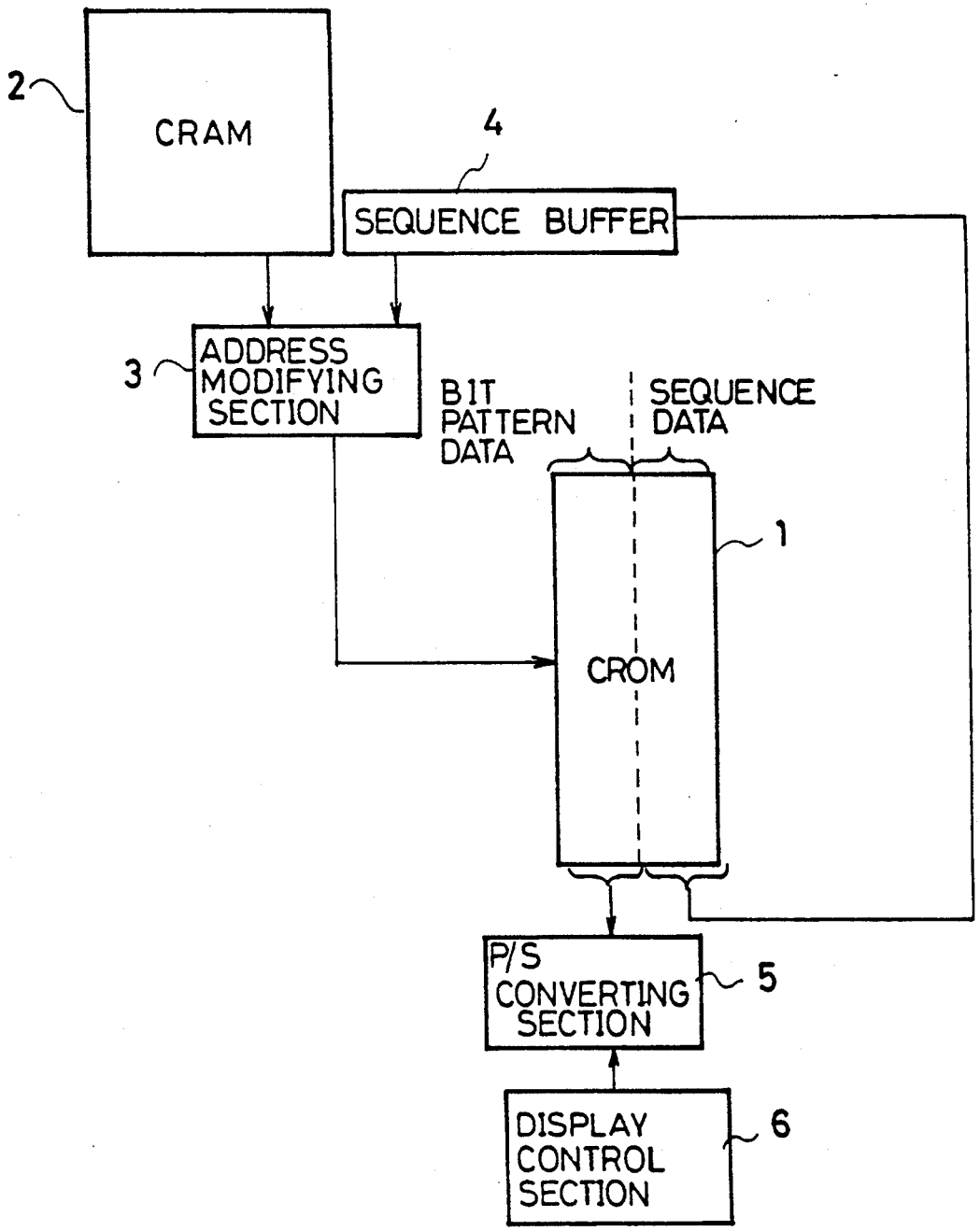
FIG. 1 is a block diagram showing a structure of a screen display element relating to an embodiment of the present invention.

FIG. 1 is a block diagram showing a structure of a screen display element relating to an embodiment according to the present invention. In FIG. 1, numeral 1 represents a CROM (character ROM) as a first memory means which stores n-bit bit pattern data as a component of a character consisted of $n \times m$ dots and sequence data having information necessary for composing n-bit m components, numeral 2 represents a CRAM (character RAM) as a second memory means having addresses corresponding to each display position on the screen which holds addresses for the CROM 1 as data, numeral 3 represents an address modifying section as an address modifying means for producing an address of a scanning line of pertinent character for the CROM 1 in accordance with address from the CRAM 2 and information in sequence data from pertinent address in the CROM 1, numeral 4 represents a sequence buffer for holding sequence data to be outputted from the CROM 1, numeral 5 represents a P/S converting section as a parallel/serial converting means for converting data outputted in parallel into serial signals necessary for screen display, and numeral 6 represents a display control section as a display control means for controlling the CROM 1, CRAM 2, address modifying section 3, sequence buffer 4, and the P/S converting section 5 and for producing image signals necessary for screen display. Here, it should be noted that the term "character" in the present embodiment includes numerals and marks.

Figure 2:
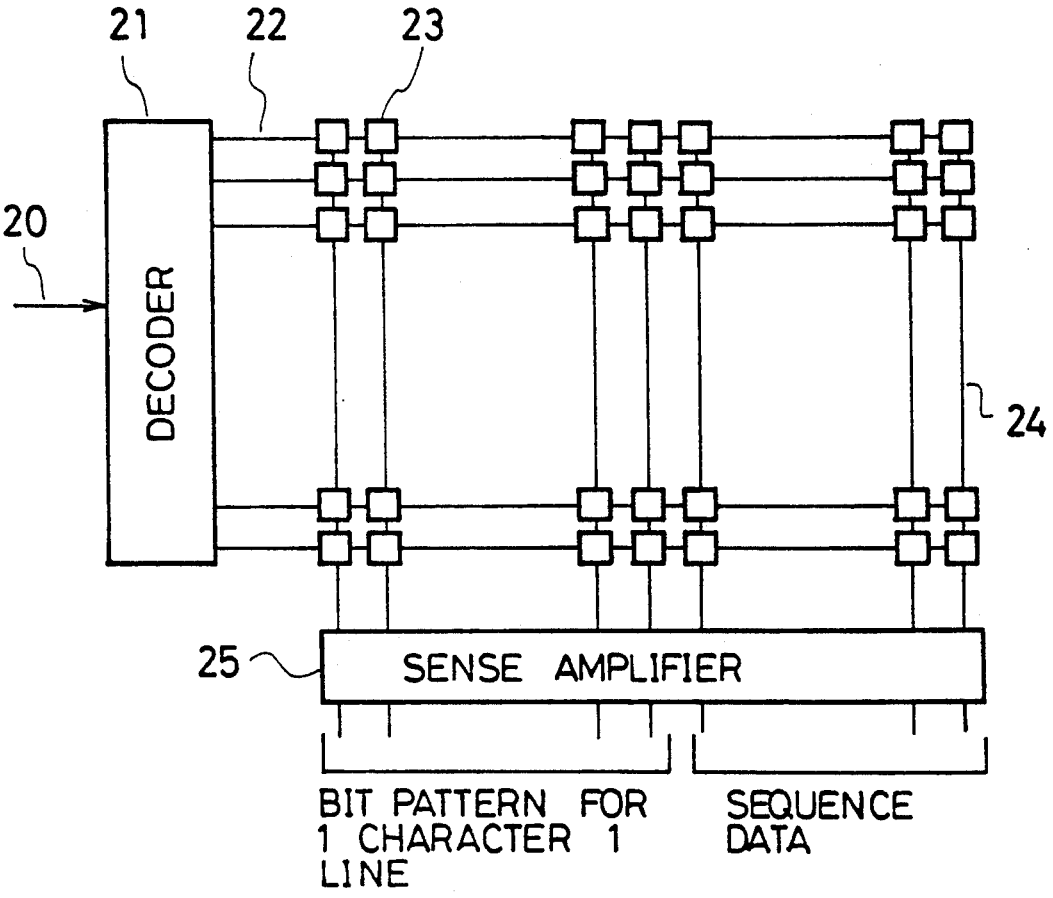
FIG. 2 is a diagram showing a structure of main part of a CROM in FIG. 1.

FIG. 2 is a diagram showing a major part of the CROM 1 in FIG. 1. In FIG. 2, the CROM 1 comprises a decoder 21 for decoding an address from an address line 20 connected to an end of the output of the address modifying section 3 in FIG. 1, memory cells 23 arranged in matrix storing bit pattern data and sequence data, data lines 24 for transmitting data of the memory cells 23 read out by signals from word lines 22, and a sense amplifier 25 for amplifying data of the data lines 24 to logic level and outputting them to the P/S converting section 5 in the FIG. 1. In this figure, the bit pattern data are stored in a plurality of memory cells 23 arranged in matrix at left-hand half and the sequence data are stored in a plurality of memory cells 23 arranged in matrix at right-hand half, respectively. Accordingly, the sense amplifier 25 outputs the bit pattern data for 1 character 1 line and pertinent sequence data.

As for the structure of the CROM 1, for example, in a case where 1 character is represented by 12 dots in width and 18 dots in length and a character set includes 256 of such a character, a pair of data of 12-bit of bit pattern data section and N-bit of sequence data section corresponds to 1 address, and first 256 addresses correspond to 12-bit data in 1st line of each representable 256 characters. As for data from 2nd line to 18th line of 256 characters (12-bit pattern data of $256\times17=4352$ sets), the minimum bit pattern data is arranged in accordance with the sequence data and a rule decided by the address modifying section 3. At this time, the bit pattern data is made not to overlap as much as possible. However, the 12-bit pattern data is of 12th power of $2=4096$ kinds, which generally include many data which are not used actually.

Like the conventional example, a specific address in the CRAM 2 corresponds to a specific position on the screen, and a written specific data corresponds to a specific character, i.e. to a specific address in the CROM 1. The structure of the CRAM 2, for example, at a case that the screen having a structure of 16 columns in width and 16 rows in length amounting to 256 characters having 1 word as 1 character holding an address (256 words=8 bits) for the CROM 1 as a 8-bit data, is of 8 bits×256 words. Among addresses of 8 bits, upper 4 bits indicate 1 row among 16 rows, and lower 4 bits indicate 1 column among 16 columns. The sequence buffer 4 can hold N-bit sequence data for lateral 16 number of columns on the screen, and sequence data to be outputted or inputted is selected by the lower 4 bits of the address for the CRAM 2.

Figure 3:
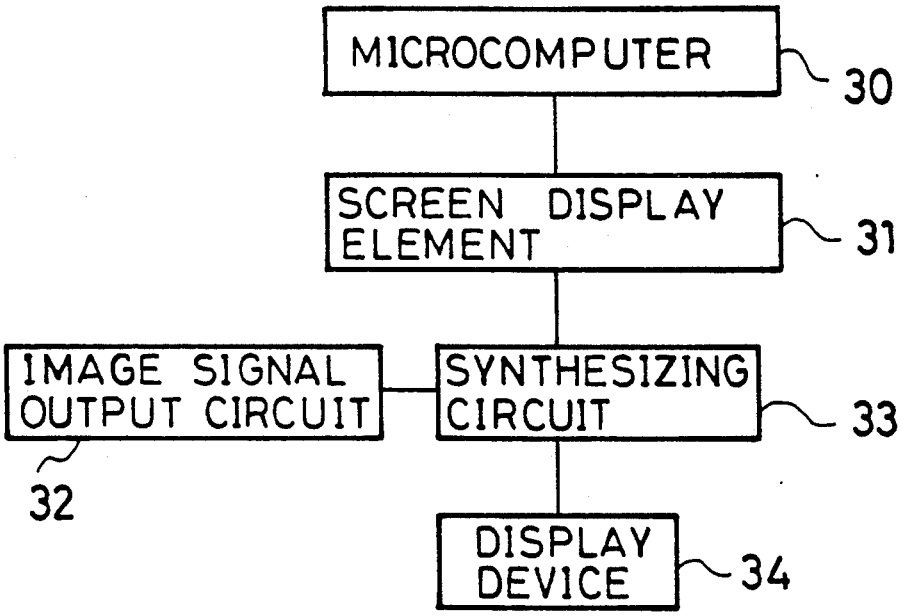
FIG. 3 is a block diagram showing peripheral circuit of the screen display element of the embodiment.

FIG. 3 is a block diagram showing a structure of peripheral circuit of the screen display element of an embodiment of the present invention. In FIG. 3, numeral 30 denotes a microcomputer for data processing, numeral 31 denotes the screen display element of the embodiment to be controlled by the microcomputer 30, numeral 32 denotes an image signal output circuit for VTR (video tape recorder), tuner, and others. Numerals 33 denotes a synthesizing circuit for synthesizing image signals from the screen display element 31 and image signals from the image signal output circuit 32, and numeral 34 denotes a display device of CRT and the like for displaying images, characters and the like in accordance with image signals synthesized at the synthesizing circuit 33. Control signals from the microcomputer 30 are inputted to the CRAM 2 in the screen display element 31, and image signals from the display control section 6 in the screen display element 31 is inputted to the synthesizing circuit 33.

Figure 4:
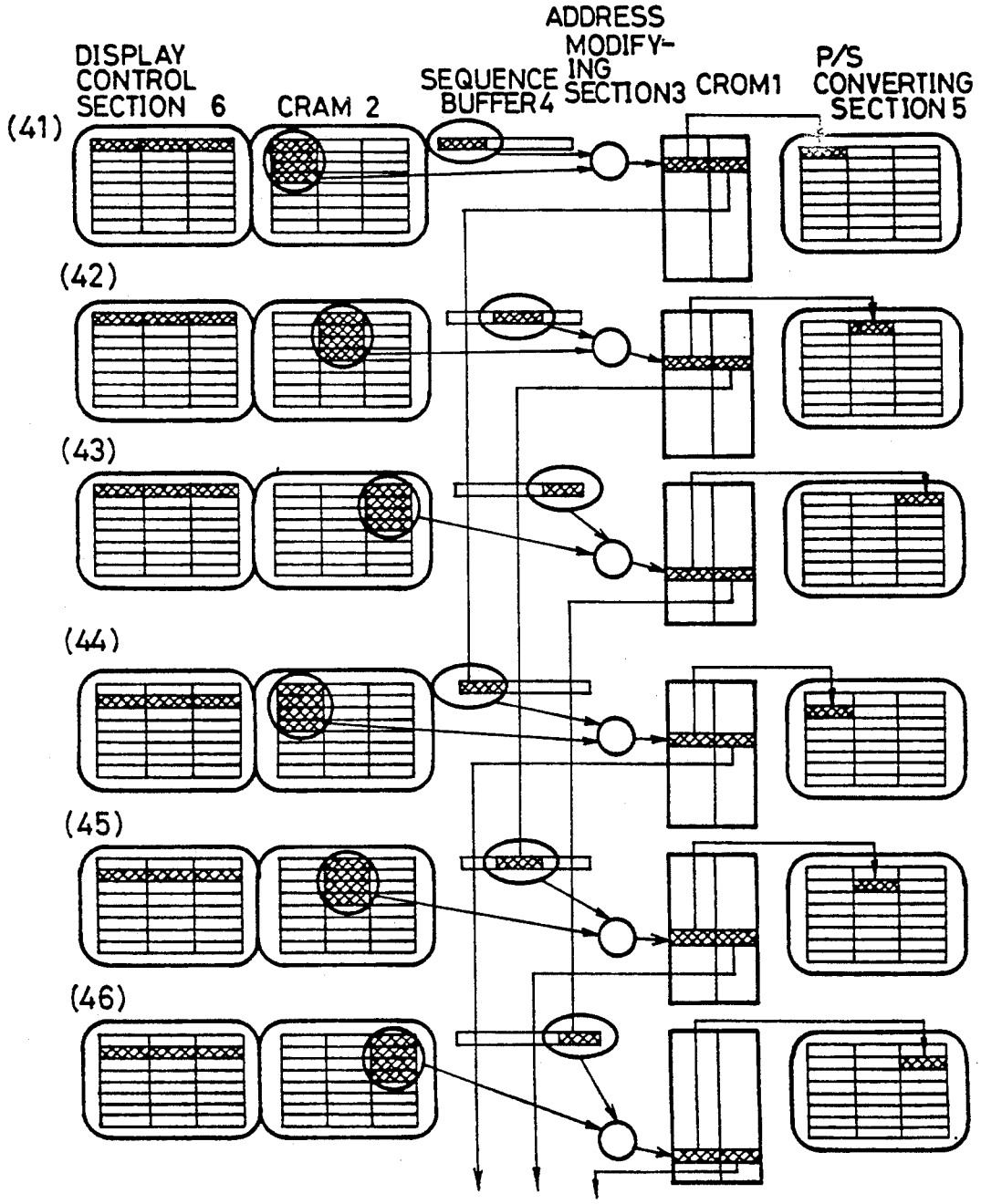
FIG. 4 is a flowchart showing operating procedure of the embodiment.
Figure 5:
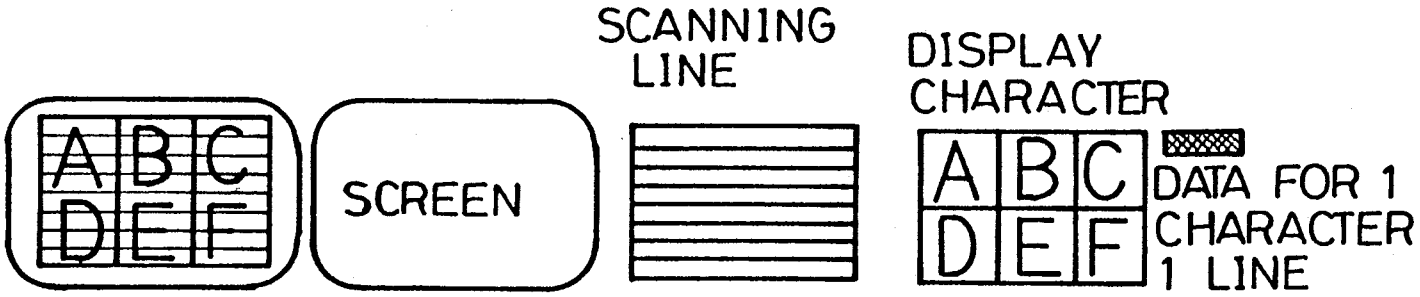
FIG. 5 is an auxiliary illustration for FIG. 4.

FIG. 4 is a flowchart showing the operational procedure in this embodiment. FIG. 5 is an auxiliary illustration for FIG. 4. At steps 41–46 in FIG. 4, the display control section 6 requests the CRAM 2 for data for a line of the scanning line. The address modifying section 3 indicates 1 address in the CROM 1 in accordance with an address (character identification information) from the CRAM 2 and sequence data (modification information) from the sequence buffer 4. Thereafter, the CROM 1 outputs bit pattern data for 1 line of 1 display character and sequence data (modification information) for next line. Consequently, the P/S converting section 5 converts data for 1 line of 1 character sent sequentially into serial 1 line data.

Referring to FIGS. 1 through 5, the operation of the screen display element of this embodiment will now be explained.

Like the conventional example, data written in the CRAM 2 correspond to characters (marks and the like) to be displayed on the screen. When a specific character is to be displayed on a specific position on the screen, data corresponding to the specific character is written in address memory corresponding to the specific position in the CRAM 2. The data written in the CRAM 2 corresponds to the specific address in the CROM 1. For example, it is assumed that data "0" corresponds to 12-bit bit pattern data in 1st line of a character "A" and sequence data which is of information for generating address after 2nd line, and data "1" corresponds to 12-bit bit pattern data in 1st line of a character "B" and sequence data which is of information for generating address after 2nd line.

Now, first operation is to write a specific data in a specific address in the CRAM 2 by means of the microcomputer 30. For example, a data "0" is written in an address "0" and a data "1" is written in an address "1" in the CRAM 2. The specific address in the CRAM 2 corresponds to the specific position on the screen. Here, the address "0" and the address "1" correspond to 1st column in 1st row and to 2nd column in 1st row on the screen, so that an "AB" will be displayed at upper left hand side on the screen. The display control section 6 makes the CRAM 2, sequence buffer 4, address modifying section 3, CROM 1 and P/S converting section 5 output necessary data at a timing necessary for screen display, so as to perform a screen display. Supposing that an actual screen display is performed by a scanning line which proceeds from left to right and from upper part to lower part, the screen display is performed by the following procedure.

When 1st line on the screen is to be displayed (steps 41, 42, 43), the display control section 6 gives sequentially addresses corresponding to 1st row to the CRAM 2 and the sequence buffer 4. Data read out sequentially from the CRAM 2 is given to the address modifying section 3 as an address. The sequence buffer 4, in case of 1st line, gives an information "not modify the address" to the address modifying section 3. The address modifying section 3, in case of 1st line, gives an address indicating 1st line of a character represented by data to the CROM 1, and 12-bit bit pattern data in 1st line of the character in 1st roland N-bit sequence data which is of information for generating an address after 2nd line of said character are read out from the CROM 1. The sequence buffer 4 stores N-bit sequence data which is of information for generating an address after 2nd line of the pertinent column to be outputted from the CROM 1. The P/S converting section 5 converts 12-bit parallel data to be outputted from the CROM 1 into serial data and output it. The display control section 6 converts the serial data to be outputted from the P/S converting section 5 into image signals necessary for the screen display so as to display on the display device 34.

When 2nd line on the screen is to be displayed (steps 44, 45, 46), like in the case of 1st line, the display control section 6 gives sequentially address corresponding to the 1st row to the CRAM 2 and the sequence buffer 4. Data read out sequentially from the CRAM 2 is given to the address modifying section 3 as an address. The sequence buffer 4, in case of after 2nd line, gives the sequence data read out from the CROM 1 last time to the address modifying section 3. The address modifying section 3 generates an address of the set of 12-bit pattern data in the 2nd line and sequence data in accordance with N-bit sequence data to be outputted from the sequence buffer 4 and address data from the CRAM 2 and output it. The sequence buffer 4 stores N-bit sequence data which is of information for generating an address after 3rd line of pertinent column to be outputted from the CROM 1. The P/S converting section 5 converts 12-bit parallel data to be outputted from the CROM 1 into serial data and outputs it. The display control section 6 converts the serial data to be outputted from the P/S converting section 5 into image signals necessary for the screen display and displays it on the display device 34.

Accordingly, when an arbitrary Nth line on the screen is to be displayed, the display control section 6 gives sequentially an address corresponding to $\{(N-1)\div 18+1)\}$th row to the CRAM 2 and the sequence buffer 4. A data representing a character in $\{(N-1)\div 18+1\}$th row read out from the CRAM 2 is supplied to the address modifying section 3. The sequence buffer 4 supplies a sequence data read out from the CROM 1 in $(N-1)$th line to the address modifying section 3. The address modifying section 3 generates an address of the set of the 12-bit pattern data in Nth line and sequence data in accordance with N-bit sequence data to be outputted from the sequence buffer 4 and the address data from the CRAM 2, and outputs it. The sequence buffer 4 stores N-bit sequence data which is of information generating an address after $(N+1)$th line of pertinent column to be outputted from the CROM 1. The P/S converting section 5 converts 12-bit parallel data to be outputted from the CROM 1 into serial data and outputs it. The display control section 6 converts the serial data to be outputted from the P/S converting section 5 into image signal necessary for screen display so as to display on the display device 34.

Figure 7:
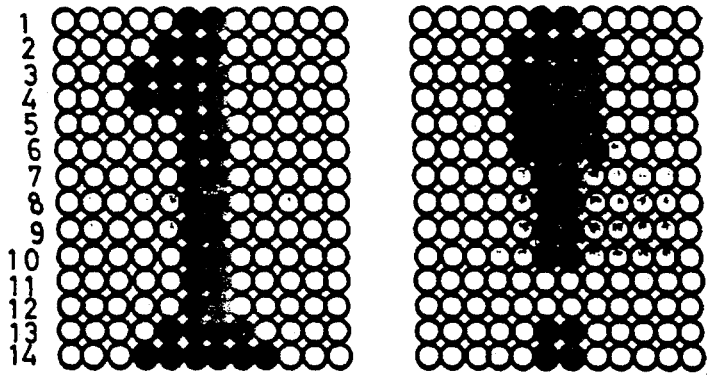
FIG. 7 is a diagram for describing a structure where 12-bit pattern data in first line also does not overlap as much as possible, in the above embodiment
Figure 8:
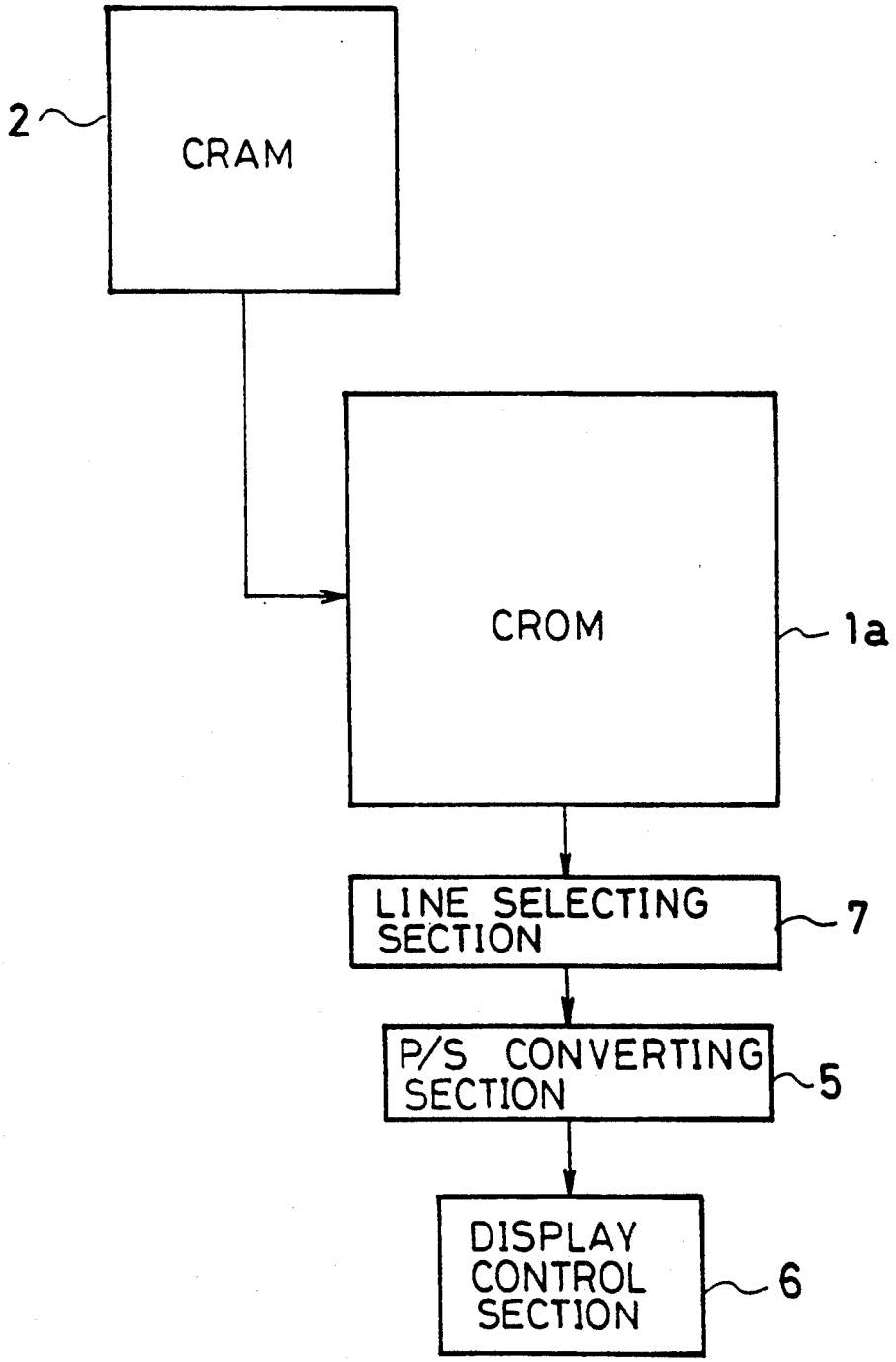
FIG.8 PRIOR ART
FIG. 8 is a block diagram showing a structure of a conventional screen display element.
Figure 9:
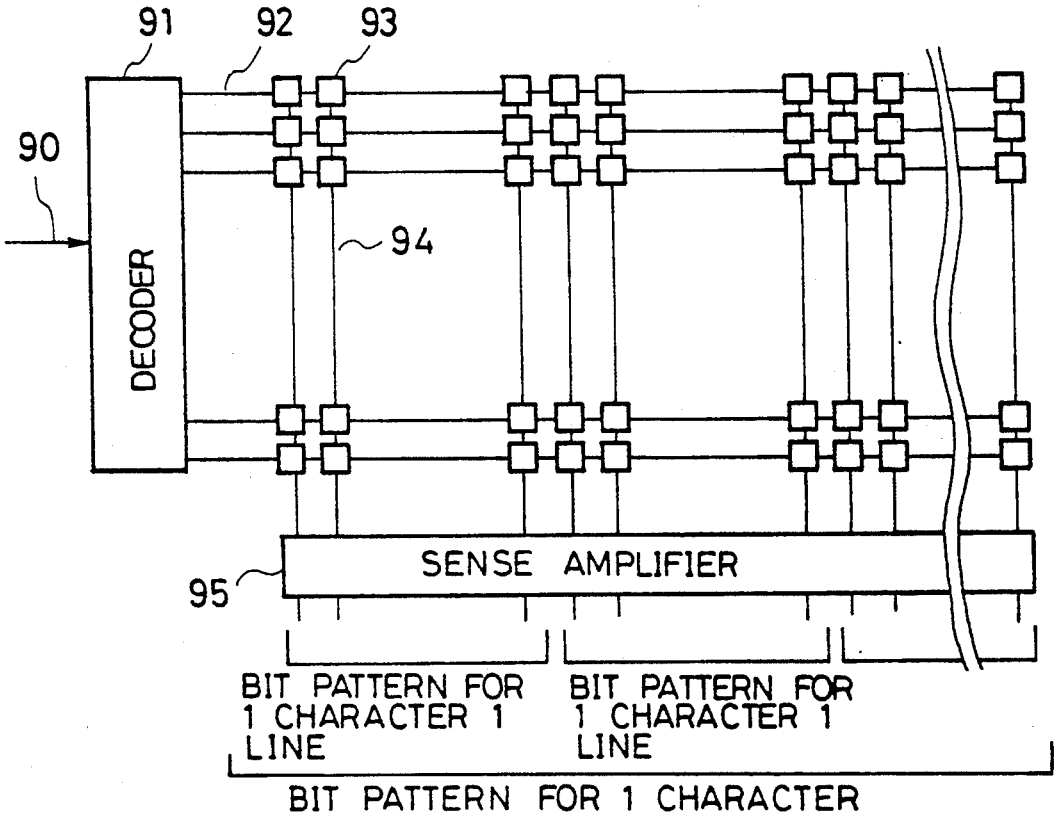
FIG.9 PRIOR ART
FIG. 9 is a diagram showing a structure of main part of the CROM in FIG. 8.
Figure 10:
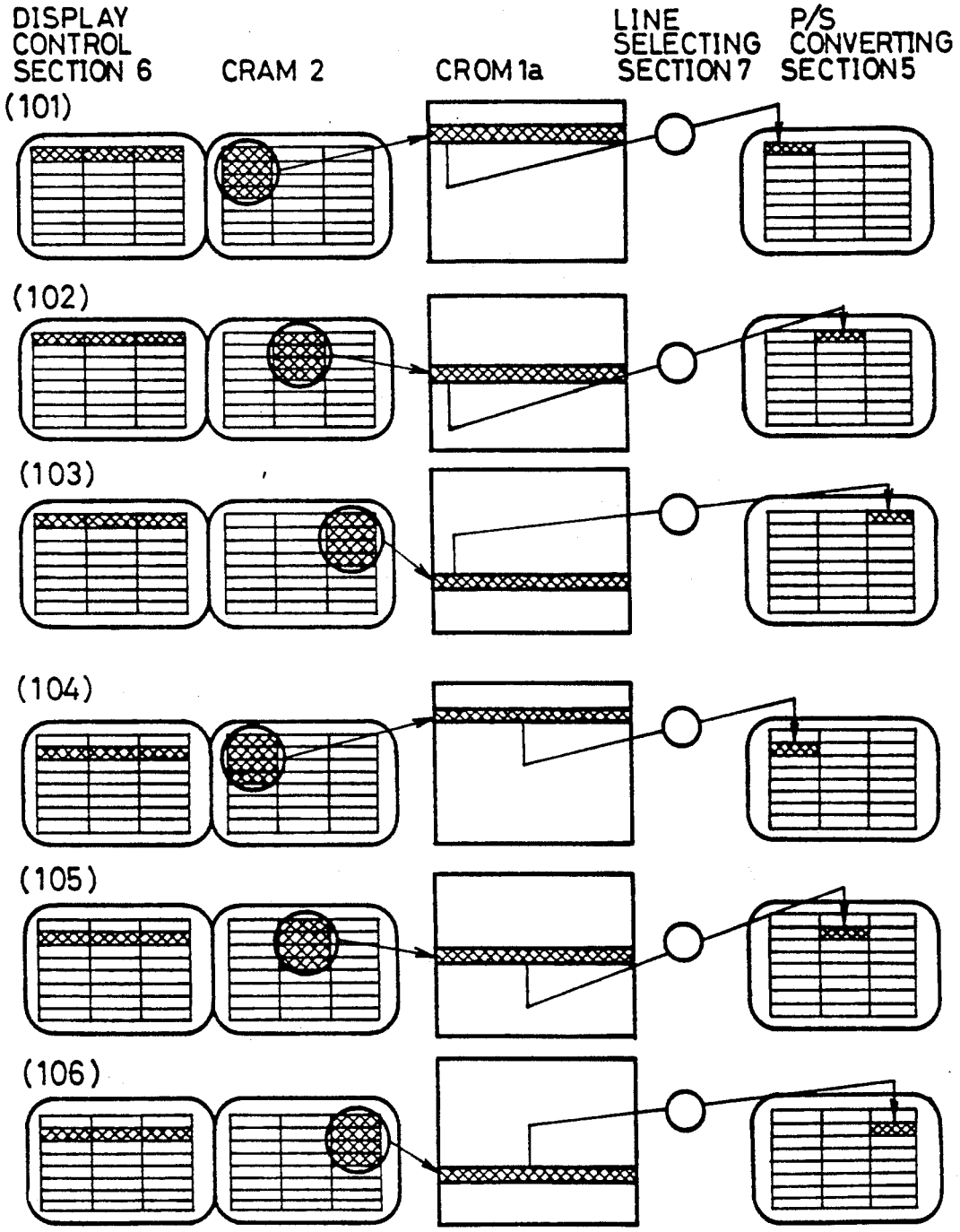
FIG. 10 PRIOR ART
FIG. 10 is a flowchart showing operating procedure in the conventional display element.
Figure 11:
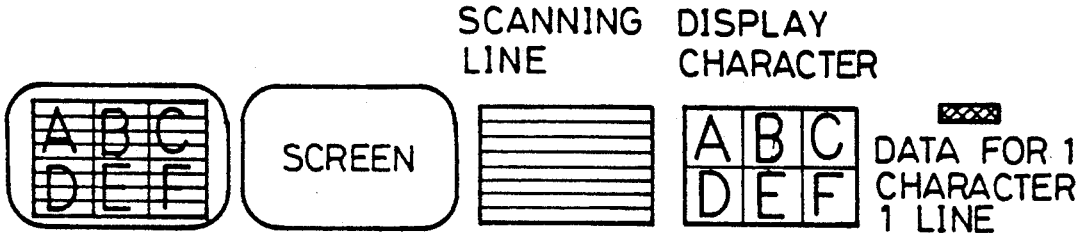
FIG. 11 PRIOR ART
FIG. 11 is an auxiliary illustration for FIG. 10.
Figure 12:
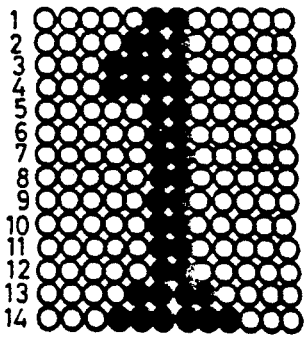
FIG. 12 PRIOR ART
FIG. 12 is a diagram for describing that character information has a high redundancy.

As the structure of the CROM 1 in this embodiment, for example, in a case where 1 character is represented by 12 dots in width and 18 dots in length and a character set includes 256 of such a character, a pair of data with 12-bit of bit pattern data section+N-bit of sequence data section corresponds to an address, and the first 256 address correspond to 12-bit pattern data in 1st line of each of the representable 256 characters. However, the 12-bit bit pattern data in the 1st line may also be constructed so as not to overlap as much as possible. In this embodiment, the addresses for the bit pattern data in the 1st line with respect to all characters varies. However, bit pattern data for "1" will be the same as "!" in the 1st line as shown in FIG. 7. Such addresses of the characters whose bit pattern data in the 1st line can be made to be common, that is, are made so as not to overlap. Consequently, it is further possible to reduce the redundancy of the character information. In this case, the sequence data in the address modifying section 3 and the CROM 1 will be slightly increased, whereas number of words in the CROM 1 will be decreased.

Figure 6:
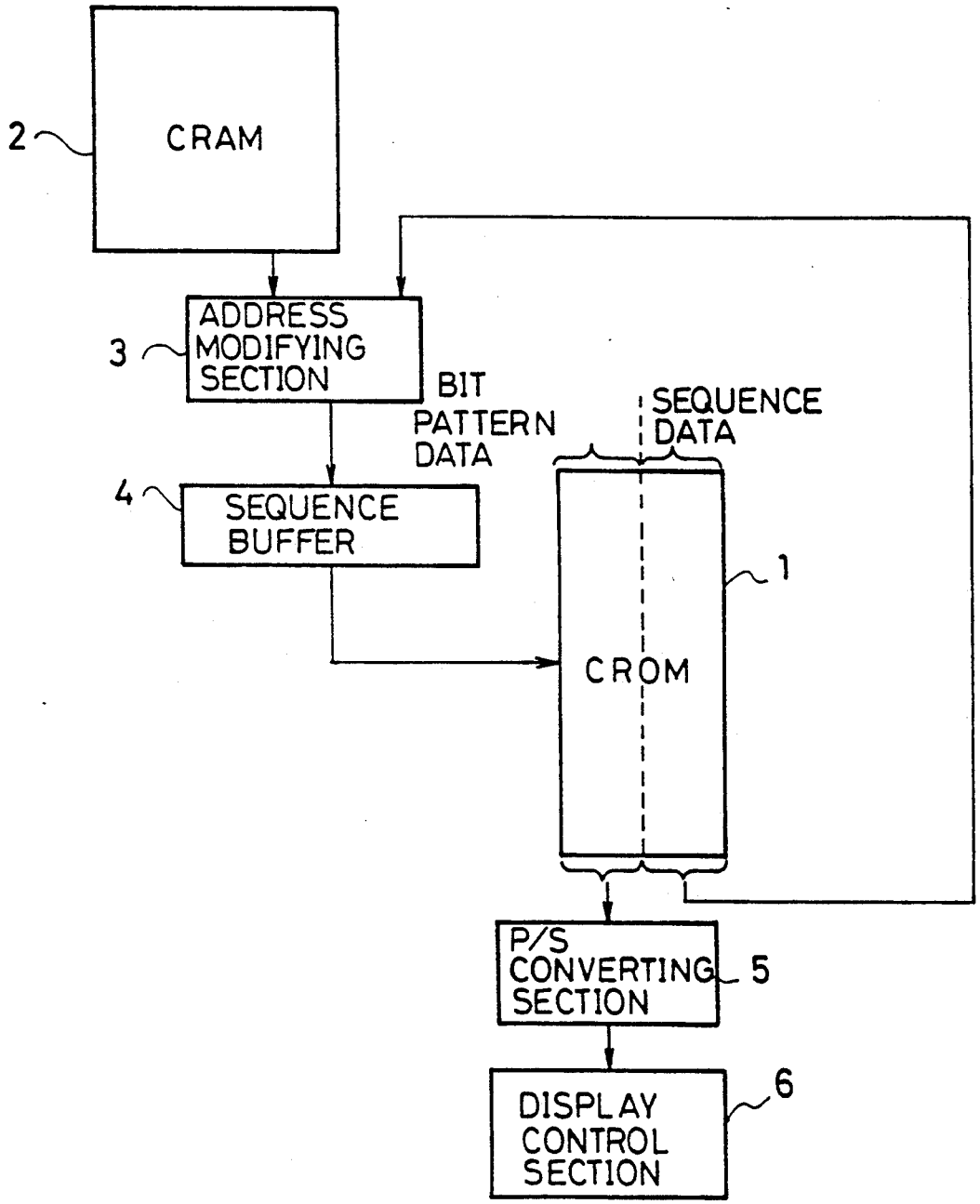
FIG. 6 is a block diagram showing a structure of the screen display element relating to other embodiment of the present invention.

In the above-mentioned embodiment, the sequence buffer 4 holds the sequence data to be outputted from the CROM 1 and inputs the sequence data as well as an address in next line into the address modifying section 3. However, like other embodiment shown in FIG. 6, the sequence data may be inputted to the address modifying section 3 directly from the CROM 1 during the process of the present line, and the sequence buffer 4 may hold an address which selects directly a word in the CROM 1 for next line.

According to the present invention, as described above, the bit pattern data for 1 character is not provided for each of all characters. As a component of the character composed by $n\times m$ dots, n-bit bit pattern data and sequence data having information necessary for composing n-bit m components are stored in the first memory means, the address of the scanning line with respect to pertinent character for the first memory means is produced by the address modifying means in accordance with the address from the second memory means and said sequence data, and the bit pattern data is read out from the first memory means according to this address, so that the capacity of the first memory means can be made to be smaller than the conventional means, and moreover, the same quantity as the conventional way of character information can be obtained, thereby enabling to reduce the manufacturing cost by miniaturizing the first memory means.

What is claimed is:

1. A screen display control system for displaying characters, included in a set of N characters, on a screen having a first plurality of display locations, where each character includes at least a first and second lines of dots to be displayed, said system comprising:

a first memory including a first plurality of storage locations, each storage location accessed by a unique address in a first memory address space, where N unique first line addresses in said first memory address space access N unique first line storage locations storing the first line of each character in the set of characters, with the first line storage location storing the first line of a given character also storing associated sequence data indicating a second line address in said first memory address space accessing one of a plurality of second line storage locations, each second line storage location storing a unique second line of one of said N characters;

a second memory including a second plurality of storage locations, each storage location accessed by a unique address in a second memory address space, with each address in said second memory address space also indicating a unique display location on the screen, each storage location in said second memory storing one of said N first line addresses in said first memory address space; and address modification means, coupled to receive said first line addresses stored in said second memory and said sequence data stored in said first memory, for outputting said first line address to access one of said first line storage locations storing a first line of a given character and said associated sequence data and for utilizing said retrieved sequence data to modify said first line address into a second line address that accesses said second line storage location storing said unique second line of the given character.

2. The screen display control system of claim 1 further comprising a parallel/serial converting means, coupled to said first memory, for converting the first line of each character and the second line of each character output from said first memory in a parallel format to a serial format sufficient for use by the screen in displaying the characters.

3. The screen display control system of claim 2 further comprising display control means for controlling the operation of said first memory, said second memory, said address modifying means, and said parallel/serial converting means.

4. The screen display control system of claim 1 wherein said first memory is a read only memory.

5. The screen display control system of claim 4 wherein said read only memory comprises a plurality of memory cells that store said first line of each character and said associated sequence data, said plurality of memory cells being arranged in a matrix formation.

6. The screen display control system of claim 1 wherein said second memory is a random access memory.

7. A screen display control system for displaying characters, included in a set of N characters, on a screen having a first plurality of display locations, where each character includes at least a first line of dots and M subsequent lines of dots to be displayed, said system comprising:

a first memory including a first plurality of storage locations, each storage location accessed by a unique address in a first memory address space, where N unique first line addresses in said first memory address space access N unique first line storage locations storing the first line of dots of each character in the set of characters, with the first line storage location storing the first line of a given character also storing associated sequence data indicating addresses of said M subsequent lines of dots, each of said addresses being one of said first line addresses or a subsequent line address in said first memory address space accessing one of a plurality of subsequent line storage locations, each subsequent line storage location storing a unique subsequent line of dots of one of said N characters;

a second memory including a second plurality of storage locations, each storage location accessed by a unique address in a second memory address space, with each address in said second memory address space also indicating a unique display location on the screen, each storage location in said second memory storing one of said N first line addresses in said first memory address space; and address modification means, coupled to receive said first line addresses stored in said second memory and said sequence data stored in said first memory, for outputting said first line address to access one of said first line storage locations storing a first line of a given character and said associated sequence data and for utilizing said retrieved sequence data to modify said first line address into addresses of each of said M subsequent lines of dots.

8. The screen display control system of claim 7 further comprising a parallel/serial converting means, coupled to said first memory, for converting the first line of each character and the subsequent lines of each character output from said first memory in a parallel format to a serial format sufficient for use by the screen in displaying the characters.

9. The screen display control system of claim 8 further comprising display control means for controlling the operation of said first memory, said second memory, said address modifying means, and said parallel/serial converting means.

10. The screen display control system of claim 7 wherein said first memory is a read only memory.

11. The screen display control system of claim 10 wherein said read only memory comprises a plurality of memory cells that store said first line of each character and said associated sequence data, said plurality of memory cells being arranged in a matrix formation.

12. The screen display control system of claim 7 wherein said second memory is a random access memory.

* * * * *